United States Patent [19]

Sakamoto et al.

[11] Patent Number: 4,564,588

[45] Date of Patent: Jan. 14, 1986

[54] SILVER HALIDE PHOTOGRAPHIC MATERIAL FOR RADIOGRAPHY

[75] Inventors: Eiichi Sakamoto, Hanno; Mikio Kawasaki, Hino; Kouji Ono, Mizuho; Tomomi Yoshizawa, Hachioji, all of Japan

[73] Assignee: Konishiroku Photo Industry Co., Ltd., Tokyo, Japan

[21] Appl. No.: 698,746

[22] Filed: Feb. 6, 1985

Related U.S. Application Data

[63] Continuation of Ser. No. 455,263, Jan. 3, 1983, abandoned.

[30] Foreign Application Priority Data

Jan. 12, 1982 [JP] Japan ..... 57-3767

[51] Int. Cl.[4] ..... G03C 1/36; G03C 1/84

[52] U.S. Cl. ..... 430/509; 430/502; 430/506; 430/966; 430/967; 430/408; 430/495; 430/606

[58] Field of Search ..... 430/506, 502, 509, 606, 430/966, 967, 408, 495

[56] References Cited

U.S. PATENT DOCUMENTS 3,671,254 6/1972 Dostes ..... 430/966
3,923,515 12/1975 Van Stappen ..... 430/966

FOREIGN PATENT DOCUMENTS 54-048544 4/1979 Japan .

*Primary Examiner*—Won H. Louie
*Attorney, Agent, or Firm*—Jordan B. Bierman

[57] ABSTRACT

Silver halide photographic material for radiography comprising a transparent support having a hydrophilic colloid layer coated on each side thereof said layer comprising (a) photosensitive silver halide grains, (b) silver halide grains having surfaces covered with a solubility reducing agent and which, in the absence of said solubility reducing agent, are more soluble in a material capable of dissolving silver halide than said (a), said (b) having a sensitivity to light generally less than 1/10 that of said (a), and (c) physical development nuclei, wherein the molar ratio of (a) to (b), based on the silver content of each, is between 1:0.1 to 1:0.8 on each side of said support and the total silver content of (a) and (b) is from 1 to 8 g/m$^2$.

6 Claims, No Drawings

SILVER HALIDE PHOTOGRAPHIC MATERIAL FOR RADIOGRAPHY

This application is a continuation of application Ser. No. 455,263, filed Jan. 3, 1983, abandoned which claims priority of Japanese Application No. 3767/1982, filed Jan. 12, 1982, abandoned.

FIELD OF THE INVENTION

The present invention relates to a silver halide photographic material for recording image by radiography. More particularly, the invention relates to a photographic material for radiography that uses less silver and which yet has high sensitivity to X-rays and exhibits high covering power.

BACKGROUND OF THE INVENTION

To absorb fluctuations in the price and supply of silver that is indispensable to silver halide photographic materials, intensive efforts are being made to reduce the use of silver or entirely eliminate it. But to produce a silverless photographic material for radiography that has both high sensitivity and high image density is almost impossible, and instead there is a great need for reducing the silver content of the material. However, reducing the silver content while maintaining the sensitivity of the existing black-and-white X-ray film with an emulsion coating on both sides is very difficult without reducing the maximum image density and impairing the granularity of silver halide grains and the sharpness of image.

Among the methods known to produce a photographic image of high density by using less silver is the silver salt diffusion transfer (DTR) process. This method is recognized as being very effective in silver reduction because it provides a transfer image having a very high covering power and hence achieves high sensitivity, image density and sharpness with reduced silver content. But the DTR process is a positive-positive process and provides a positive final image. Therefore, this process cannot be applied to an X-ray film that forms a negative image as an information source for diagnosis.

Japanese Patent Publication No. 3835/70 describes a diffusion transfer process that uses less silver and forms a developing negative image by using a processing solution containg a solubility increasing agent that is capable of forming an insoluble complex compound with silver halide. But the negative image produced by this process is by no means completely satisfactory. Japanese Patent Application (OPI) No. 48544/79 (the symbol OPI as used herein means an unexamined published Japanese patent application) describes a new negative image forming method which uses a photographic element wherein a photosensitive silver halide layer (1) is combined with a layer (2) of metal salt grains that are more soluble than the silver halide grains of layer (1) and which are substantially devoid of sensitivity and on which a solubility decreasing agent is adsorbed and with a layer (3) of physical developing nuclei. When this element with a silver halide layer formed on one side is directly applied to a photographic material for radiography of the type contemplated by the present invention, both the fixing speed and the film drying speed are delayed; the former is delayed because of the silver coating weight and the solubility reducing agent (to be described later), and the latter is prolonged due to the total binder content. As a result, if the element is subjected to rapid processing (90 seconds) by the common X-ray automatic processor, insufficient fixing produces a stained silver image or causes discoloration during storage, and no satisfactory diagnostic information is obtained. Furthermore, insufficient drying causes film blocking or transfer of streaks from the squeegee rollers onto the image.

SUMMARY OF THE INVENTION

Therefore, one object of the present invention is to provide a silver halide photographic material for radiography that contains less silver and which yet has high sensitivity and image density and produces an image of good quality.

Another object of the invention is to provide a silver halide photographic material for radiography that produces an image of good quality when it is subjected to rapid processing at high temperatures by an aotomatic processor.

These and other objects of the present invention will become apparent by reading the following description.

As a result of various studies to attain these objects, we have found that they can be achieved by a silver halide photographic material for radiography which has on each side of a transparent support a hydrophilic colloidal layer comprising (a) photosensitive silver halide grains, (b) silver halide grains whose surface is rendered hardly soluble by a solubility reducing agent and which themselves are more soluble than the photosensitive silver halide grains (a) and are substantially devoid of sensitivity, and (c) physical developing nuclei, the molar ratio of (a) to (b) with respect to silver being from 1:0.1 to 1:0.8 on each side and the total silver content of (a) and (b) being from 1 to 8 g/m$^2$.

DETAILED DESCRIPTION OF THE INVENTION

The photosensitive silver halide grains (a) used in the photographic material of the present invention are made of silver chloride, silver bromide, silver iodide, silver chlorobromide, silver iodobromide, silver chloroiodobromide or a mixture of two or more thereof. For providing higher sensitivity, silver iodobromide is preferred, and one containing not more than 50 mol % of silver iodide is particularly preferred.

The photosensitive silver halide grains are used in the present invention in the form of a silver halide emulsion wherein they are dispersed in a hydrophilic colloid. This emulsion can be prepared by any known method, such as the one described in Japanese Patent Publication No. 7772/71, or the conversion method (e.g. the single-jet or doublejet method) described in U.S. Pat. No. 2,592,250. The photosensitive silver halide grains used in the present invention may have various crystal habits. Their grain size is generally in the range of from 0.1 to 3.0 microns.

The emulsion described above may be chemically sensitized by any conventional method. Typical chemical sensitizers include gold compounds such as chloroaurates and gold trichloride, salts of noble metals such as platinum, palladium, iridium, rhodium and ruthenium, sulfur compounds that react with silver salts to form silver sulfide, and reducing compounds such as amines and stannous salts. The emulsion may also be spectrally sensitized by known sensitizing dyes.

The emulsion may contain a stabilizer, an antifoggant, a surfactant, a hardener, a development accelerator and the like. To prevent increased fog and reduced sensitivity during the preparation or storage of emulsion or during development, many heterocyclic compounds and mercapto compounds such as 4-hydroxy-6-methyl-1,3,3a-7-tetrazaindene, 1-phenyl-5-mercaptotetrazole and dihydroxybenzene may be added. For various purposes such as improved coating of the emulsion, as well as stabilized emulsification or dispersion, accelerated development and prevention of static buildup, surfactants may be added either individually or in combination. Any known surfactants may be used and they include anionic surfactants having an acidic group such as saponin, nonionic surfactants such as polyalkyl oxide and glycidol, cationic surfactants such as alkylamine and ammonium salts, as well as amphoteric surfactants. The emulsion can be hardened by an ordinary method. Suitable hardeners may be selected from among known compounds such as aldehydes, vinyl sulfones and epoxys.

The silver halide grains (b) that are more soluble than the silver halide grains (a) and which are substantially devoid of sensitivity are defined as "silver halide grains which when not covered with a solubility reducing agent, dissolve faster than the silver halide grains (a) in a material capable of dissolving silver halide and which are substantially devoid of sensitivity". More specifically, given an equal number of grains (a) and (b), group (A) of the grains (b) has a faster dissolution rate (the weight of the material that has dissolved in a unit time) than group (B) of the grains (a) in the presence of at least one solubilizer (to be described later) for the silver halide of which the grains (b) are made (for instance, in the processing solution used in the present invention).

The following method can be used to check if the above requirement is met. First, prepare two emulsions, one containing silver halide grains (a) in hydrophilic colloid and the other containing silver halide grains (b) in hydrophilic colloid. Apply the respective emulsions onto two supports, and dry to form two samples. Care must be taken that each sample contains the same amounts of silver halide and hydrophilic colloid per unit area. Immerse the two samples in 5% aqueous sodium thiosulfate (20° C.) for a period of less than 10 seconds (e.g. 2, 5 or 8 seconds) without stirring. Immediately thereafter, transfer the samples into a water tank where they are washed, and from which they are removed and dried. Determine the percent residual silver halide of each sample by a known method. Draw a residual silver halide vs. immersion time curve, read from the curve the immersion time $t_1$ for 50% residual silver halide of grains (a) and the immersion time $t_2$ for the same value of grain (b), and calculate $t_2/t_1$. For the purposes of the present invention, the value of $t_2/t_1$ must be less than 1, preferably less than 0.7.

The "solubilizer for the silver halide of which the grains (b) are made" (hereinafter referred to as a silver halide solubilizer) means a material that acts on the grains (b) to form silver ions or soluble silver complex ions, and it may be the solvent (e.g. water) for the processing solution to be described hereinafter that is used in the present invention. The silver halide solubilizer is preferably a material that substantially does not dissolve the photosensitive silver halide of which the grains (a) are made or which, when added in an amount that substantially does not dissolve said silver halide, dissolves the silver halide of which the grains (b) are made and which has a different solubility than the photosensitive silver halide. Examples of such material include sulfites such as sodium sulfite, thiosulfates such as sodium thiosulfate, potassium thiosulfate and ammonium thiosulfate, cyanides such as potassium cyanide and sodium cyanide, thiocyanates such as sodium thiocyanate and potassium thiocyanate, amino acid compounds such as cystine and cysteine, thiourea compounds such as thiourea and 3,6-di-thia-1,8-octadiol, and thioether compounds.

The grains (b) used in the present invention are silver halide grains that are substantially devoid of sensitivity, and they have a greater solubility than the grains (a) in a material that is capable of dissolving silver halide. Preferred grains (b) are pure silver bromide or chloride grains that have not been chemically sensitized, or a mixture of these grians, and it is particularly preferred that they be finer crystals than the photosensitive silver halide grains (a).

For the purposes of the present invention, the wording "substantially devoid of sensitivity" means that the grains (b) are "non-sensitive" relative to the grains (a), and more specifically, this wording should be construed to mean that when the photographic material of the present invention is given the necessary light energy to cause photochemical reaction in the grains (a), the grains (b) "remain substantially inert" to said light energy. To state more concretely, the sensitivity of the grains (b) is generally less than 1/10 of that of the grains (a). When the grains (b) are dissolved, they produce silver ions or soluble silver complex ions, which are reduced to metallic silver on physical developing nuclei in the presence of a reducing agnet. The grains (b) are contained in the hydrophilic colloidal layer of the present invention in an amount of 0.1 to 0.8 mole per mole of the grains (a).

The surface of the grains (b) according to the present invention is covered with a solubility reducing agent, which by adsorbing on the surface of the grains (b) or part of their surface that provides active sites for dissolution reaction, retards the dissolution rate of said grains in the presence of the silver halide solubilizer. The solubility reducing agent also includes compounds that adsorb on the surface of the grains (b) and form a hardly soluble salt or complex salt with the silver ion of the silver halide of which said grains are made.

In one preferred embodiment of the present invention, the solubility reducing agent is selected from among compounds that adsorb on the easily soluble grains (b) to reduce their solubility. Such compounds include mercapto compounds illustrated by cysteine, 1-phenyl-5-mercaptotetrazole, mercaptobenzothiazole, mercaptobenzoselenazole, mercaptobenzoxazole, mercaptobenzimidazole, benzyl mercaptan, 4-ethyl-2-thioxazoline, 2-mercapto-6-azauracil, 4-hydroxy-2-mercapto-6-methyl-pyrimidine and 3-mercapto-4-phenyl-5-methyl-1,2,4-triazole. Other preferred compounds are thiourea, indazoles, triazoles and imidazoles. Of these mercaptotetrazole compounds are particularly preferred. Any of the solubility reducing agents illustrated above is added in the presence of a solvent which is preferably methanol. The agent is preferably used in an amount of 0.01 to 2.0 g, more preferably from 0.1 to 1.0 g, per mole of the grains (b).

The physical developing nuclei used in the present invention may be made of colloids of noble metals such as gold, silver and platinum, sulfides of metals such as silver, palladium and zinc, and metal selenides. Gold colloids prepared by reducing gold compounds (e.g. chloroaurates) are particularly preferred. The physical developing nuclei need not be physical particles so long as they contain chemically active sites capable of catalytically accelerating the process by which the silver ion or silver complex ion produced from dissolved grains (b) is reduced to metallic silver by a reducing agent.

The photographic material of the present invention may assume various layer arrangements depending upon its use. But since it is primarily used in radiography, a double-layer structure is the most preferred wherein a support is coated successively with a hydrophilic colloidal layer containing the low-sensitivity silver halide grains and physical developing nyclei, and another hydrophilic colloidal layer containing the highly sensitive silver halide grains. If necessary, an auxiliary layer such as a protective layer or an anti-halation layer may be incorporated in a suitable position. In this most preferred embodiment, the silver coating weight is preferably such that from 0.1 to 0.8 mole of the grains (b) is present on one side of a transparent support per mole of the grains (a). The total silver content is preferably from 1 to 4 g per square meter on one side of the support. Preferably, these requirements should also be met by the hydrophilic colloidal layers to be formed on the other side of the support.

As described above, the physical developing nuclei (c) may be composed of metals or metal sulfides, but preferably, they are made of reduced gold salts. While they may be used in various embodiment, the most preferred embodiment is such that they are incorporated in the hydrophilic colloidal layer containing the grains (b) with a view to catalyzing the reduction of silver ion or silver complex ion to metallic silver. In this embodiment, the nuclei are generally used in an amount of from 0.01 to 10 mg, preferably from 0.1 to 1 mg, per square meter on one side of the support.

The three components (a), (b) and (c) of the present invention may be coated onto a support as they are dispersed in a hydrophilic binder either singly or in admixture. Illustrative hydrophilic binders include cellulose derivatives such as gelatin, colloidal albumin, casein, carboxymethyl cellulose and hydroxyethyl cellulose, as well as synthetic polymers such as polyvinyl alcohol, poly-N-vinyl pyrrolidone, polyacrylic acid copolymer, polyacrylamide, and derivatives and partial hydrolyzates thereof. If necessary, two or more of these binders may be used in combination. Gelatin is the best suited for practical purposes. Modified gelatin derivatives prepared by reacting the functional group of gelatin with a certain reagent, and graft polymers wherein the gelatin is combined with other polymeric materials may also be employed.

When any of the hydrophilic binders listed above is incorporated in one of the elements of the photographic material of the present invention, the amount thereof used is important because the photographic film must have rapid developability, fixability, washability and dryability in the processing with an automatic processor (development and fixing within 20 to 60 seconds at about 25° to 40° C. and drying within 10 to 30 seconds at about 50° C.), while, at the same time, the binder determines the physical properties of the film such as resistance to abrasion during transport through rollers or resistance to the roller pressure. Needless to say, the amount of the hydrophilic binder is also important for the preparation of the photographic material of the present invention. For the purposes of the present invention, the total amount of the hydrophilic binder is preferably from 1 to 6 g per square meter on one side of the support, and the range of from 2 to 4 g per square meter is more preferred. The total amount of the hydrophilic binder includes the amount of a binder incorporated in a protective layer that is to be formed on the topmost part of the photographic material.

The hydrophilic colloidal layer used in the present invention may further contain a thickener, a matting agent, a UV absorber, a pH regulator, an agent to control the development speed, an agent to improve granularity, a silver halide developing agent and the like in such an amount as is not detrimental to the purposes of the present invention.

Suitable supports include transparent films made of cellulose nitrate, cellulose acetate, cellulose acetate propionate, polyethylene terephthalate and polycarbonate.

The photographic material of the present invention may be developed with a processing solution containing a reducing agent after it is exposed to X-rays. An advantageous example of the reducing agent is a developing agent and any known developing agents may be used, such as polyhydroxybenzenes typified by hydroquinone, toluhydroquinone and 2,5-dimethylhydroquinone, 3-pyrazolidones typified by 1-phenyl-3-pyrazolidone and 1-phenyl-4-4-dimethyl-3-pyrazolidone, and aminophenols typified by o-aminophenol and p-aminophenol, as well as 1-(p-hydroxyphenyl)-3-aminopyrazolidone, 1-(p-methyl-aminophenol)-3-pyrazolidone and ascorbic acid. These compounds may be used either singly or in combination.

The processing solution described above contains 0.01 to 50 g per liter of the silver halide solubilizer for the grains (b). The solution may further contain an alkali agent, a pH buffer, an antifoggant, a development accelerator, a chelating agent, a preservative , a hardener and the like. If the photograhic material of the present invention is subjected to rapid processing at high temperatures in an automatic processing machine, it desirably has resistance against the roller pressure, and to this end, the use of a hardener is effective. Most effective hardeners are dialdehydes such as β-methyl glutaldehyde, glutaldehyde, α-methyl glutaldehyde, maleic dialdehyde, succinic dialdehyde, methoxysuccinic aldehyde, α-α-dimethyl glutaldehyde, methylmaleic dialdehyde, methylsuccinic aldehyde, α-methyl-β-ethoxyglutaldehyde, α-n-butoxyglutaldehyde, α-ethyl-β-ethoxyglutaldehyde, β-n-butoxyglutaldehyde, α-α-dimethoxy-succinic dialdehyde, β-isopropoxysuccinic dialdehyde, α-α-di-ethylsuccinic dialdehyde and butylmaleic dialdehyde. Any of these dialdehydes is advantageously used in an amount of about 3 to 15 g per liter of the developing solution. The pH of the developing solution is preferably held between about 9.5 and 10.5 by using an alkali metal carbonate.

The developed photographic material of the present invention may be fixed by a fixing bath of the conventional formulation, which may contain the silver halide solubilizer such as an alkali metal thiosulfate or ammonium thiosulfate. For rapid processing, good results can be obtained by incressing the concentration of this solvent and increasing the fixing temperature to about 30° C. The photographic material of the present invention can go through the entire photographic process (i.e. development, fixing, washing and drying) by roller transport mechanism within a period as short as 30 to 90 seconds.

The present invention is now described in greater detail by reference to the following examples which are given here for illustrative purposes only and are by no means intended to limit the scope of the invention.

EXAMPLE 1

(1) Preparation of High-Sensitivity Photosensitive Silver Halide Emulsion

A high-sensitivity silver iodobromide emulsion containing 4 mol % of silver iodide was prepared and subjected to gold- and sulfur-sensitization by a known method to be ripened to maximum sensitivity. The emulsion was mixed with 0.3 g of 4-hydroxy-6-methyl-1,3,3a,7-tetrazaindene (stabilizer) per mole of silver halide to thereby prepare a photosensitive emulsion.

(2) Preparation of Low-Sensitivity Silver Halide Emulsion (made of silver halide grains substantially devoid of sensitivity)

A pure silver chloride emulsion was prepared from silver nitrate and sodium chloride by the conventional neutral method, and after removal of excess salt, 0.7 g of 1-phenyl-5-mercaptotetrazole was added as a solubility reducing agent per mole of silver chloride. The resulting low-sensitivity emulsion had an average grain size of about 0.1 micron.

(3) Preparation of Physical Developing Nuclei

To 10 ml of a 1% aqueous solution of polyvinyl alcohol (degree of saponification: 99%; degree of polymerization: 1,000), 50 ml of 0.2% chloroauric acid was added. Under stirring at room temperature, 10 ml of 1% sodium borohydride was added to produce physical developing nuclei in the form of a gold colloid.

The physical developing nuclei were added to the low-sensitivity emulsion, and after adding a suitable amount of saponin as a coating aid, the resulting mixture was applied uniformly to one side of a subbed polyethylene terephthalate film. Subsequently, a coating solution comprising the high-sensitivity silver iodobromide emulsion plus suitable amounts of saponin (coating aid) and formalin (hardener) was applied to form another emulsion layer, which was then coated with a protective layer applied from an aqueous gelatin solution (3 wt %) containing sodium diethylhexyl sulfosuccinate (coating aid and formalin (hardener). The same procedure was repeated to form, in sequence, a low-sensitivity emulsion layer, a high-sensitivity emulsion layer and a protective layer on the other side of the support. This way, sample No. 1 of the silver halide photographic material for radiography according to the present invention was produced.

On each side of the sample, the high-sensitivity emulsion and the low-sensitivity emulsion were coated in such amounts that they respectively contained 3.0 g and 1.0 g of silver per square meter. The ratio of the two emulsions was 0.33 mole for the low-sensitivity emulsion as against one mole of the high-sensitivity emulsion. The physical developing nuclei contained 1.0 mg of gold per square meter, and the total coating weight of the hydrophilic binder (gelating) was 7.0 g per square meter.

A comparative sample (A) was prepared by repeating the same procedure except that on each side of the respective samples, the high-sensitivity emulsion and the low-sensitivity emulsion were coated in amounts such that both emulsions respectively contained 2.0 g of silver per square meter.

A comparative sample (B) was prepared by repeating the same procedure except that on each side of the respective samples, the high-sensitivity emulsion and the low sensitivity emulsion were coated in amounts such that both emulsions contained 4.0 g and 0.04 g of silver per square meter, respectively.

The three samples were exposed to a light source (3.2 CMS) through an optical wedge and developed for 30 seconds at 35° C. with a developing solution having the formulation indicated below. The developed samples were subsequently fixed, washed with water and dried. They were then subjected to sensitometry and the results are shown in Table 1.

| (Formulation of developer) | |
|---|---|
| Phenidone | 1.0 g |
| Anhydrous sodium sulfite | 60.0 g |
| Hydroquinone | 25.0 g |
| Potassium bromide | 4.0 g |
| Sodium hydroxide | 20.0 g |
| 5-Methylbenzotriazole | 0.1 g |
| Glutaraldehyde (25%) | 5.0 cc |
| Water to make | 1000.0 ml |
| (pH adjusted to 10.5) | |

TABLE 1

| Lot | Fog | Sensitivity* | Gamma | Maximum Density |
|---|---|---|---|---|
| Sample No. 1 of the present invention | 0.05 | 130 | 3.0 | 3.2 |
| Comparative sample (A) | 0.05 | 100 | 1.6 | 2.1 |
| Comparative sample (B) | 0.06 | 120 | 1.2 | 1.7 |

*relative sensitivity

The above data shows that the sample of the present invention had sufficient sensitivity, gamma and maximum density to be used as a photographic material for radiography.

EXAMPLE 2

Three samples of the photographic material of the present invention and two comparative samples were prepared by repeating the same procedure as in Example 1 except that the coating weights of silver in the high-sensitivity and low-sensitivity silver halide emulsions were varied as indicated in Table 2. The respective samples were irradiated with X-rays at a charging voltage of 90 kV (100 mA), and processed with a Sakura ultra highspeed X-ray automatic processor (Model QX-1200S of Konishiroku Photo Industry Co., Ltd.). The formulation of the developer used was the same as in Example 1. The fixing bath had the formulation indicated below. The processing scheme was as follows:

Development → Fixing → Washing → Drying
(30 sec, 35° C.) (15 sec, 34° C.) (10 sec, 25° C.) (35 sec, 48° C.)
└ a total of 90 sec. ┘

| (Formulation of fixing bath) | |
|---|---|
| Hypo | 250 g |
| Anyhydrous sodium sulfite | 15 g |
| Glacial acetic acid | 15 ml |
| Sodium metaborate | 13.5 g |
| Potassium alum | 15.0 g |
| Water to make | 1000.0 ml |

TABLE 2

| Lot | Amount of silver in high-sensitivity emulsion layer on both sides (g/m$^2$) | Amount of silver in low-sensitivity emulsion layer on both sides (g/m$^2$) | Remarks |
|---|---|---|---|
| Sample No. 2 of the present invention | 2.5 | 1.0 | high sensitivity, gamma and density, fixing satisfactory |
| Sample No. 3 of the present invention | 3.0 | 1.2 | high sensitivity, gamma and density, fixing satisfactory |
| Sample No. 4 of the present invention | 4.0 | 1.6 | high sensitivity, gamma and density, fixing satisfactory |
| Comparative sample (C) | 1.25 | 1.5 | no good, both density and gamma insufficient |
| Comparative sample (D) | 7.0 | 2.8 | no good, insufficient fixing caused stain |

As the above data shows, the samples of the present invention were well adapted to rapid processing with an automatic processor and could produce an X-ray image with less silver, whereas the comparative samples were not suitable for practical use because insufficient density or fixing caused staining or discoloration with the residual silver halide.

EXAMPLE 3

Three samples of the photographic material of the present invention and two more comparative samples were prepared by repeating the same procedure as in Example 2 except that the high sensitivity and low-sensitivity emulsions were coated to deposit 3.0 g and 1.2 g of silver, respectively, per square meter and that the amount of the binder for the two emulsions and the protective layer was varied as indicated in Table 3. The respective samples were subjected to rapid processing as in Example 2. The results are shown in Table 3.

TABLE 3

| Lot | Amount of gelatin used as binder on both sides (g/m$^2$) | | | Remarks |
|---|---|---|---|---|
| | high-sensitivity emulsion layer | low-sensitivity emulsion layer | protective layer | |
| Sample No. 5 of the present invention | 2.0 | 2.2 | 2.2 | dried well, good image |
| Sample No. 6 of the present invention | 2.5 | 2.5 | 2.2 | dried well, good image |
| Sample No. 7 of the present invention | 2.7 | 2.7 | 2.2 | dried well, good image |
| Comparative Sample (E) | 3.0 | 3.5 | 2.2 | insufficient drying, blocking occurred |
| Comparative Sample (F) | 3.5 | 3.0 | 2.2 | insufficient drying, blocking occurred |

As the above data shows, the samples of the present invention dried quickly after processing, but the comparative samples remained partially wet and streaks were transferred to their surface from the squeegee rollers.

What is claimed is:

1. A silver halide photographic material for radiography comprising a transparent support having a hydrophilic colloid layer coated on each side thereof, said layer comprising (a) photosensitive silver halide grains, (b) silver halide grains whose surface is covered with a solubility reducing agent and which, in the absence of said solubility reducing agent, are more soluble in a material capable of dissolving silver halide than said (a), said (b) having a sensitivity to light generally less than 1/10th that of said (a), and (c) physical development nuclei, wherein the molar ratio of (a) to (b), based on the silver content of each, is between 1:0.1 to 1:0.8 on each side of said support and the total silver content of (a) and (b) is from 1 to 8 g/m$^2$.

2. A silver halide photographic material according to claim 1, wherein the solubility reducing agent is a mercapto compound.

3. A silver halide photographic material according to claim 2, wherein the mercapto compound is a mercaptotetrazole.

4. A silver halide photographic material according to claim 1, wherein the photosensitive silver halide grains (a) are made of silver chloride, silver bromide, silver iodide, silver chlorobromide, silver iodobromide, silver chloroiodobromide or a mixture of two or more thereof.

5. A silver halide photographic material according to claim 1, wherein the photosensitive silver halide grains (b) are made of silver bromide or silver chloride which has not been chemically sensitized or a mixture thereof.

6. A silver halide photographic material according to claim 1, wherein the average diameter of the silver halide grains (b) is smaller than that of the photosensitive silver halide grains (a).

* * * * *